United States Patent [19]

Antoine et al.

[11] Patent Number: 4,921,617

[45] Date of Patent: May 1, 1990

[54] BACKWASHER ADAPTOR FOR SWIMMING POOL FILTER SYSTEM

[76] Inventors: Douglas J. Antoine, 109 Bank Avenue, Winnipeg, Manitoba, Canada, R2M 0N3; Arthur J. Antoine, 237 Stuart Avenue, Winnipeg, Manitoba, Canada, R2G 0Y6

[21] Appl. No.: 273,056

[22] Filed: Nov. 17, 1988

[51] Int. Cl.[5] ..... E04H 3/20

[52] U.S. Cl. ..... 210/776; 210/108; 210/169; 210/411; 210/416.2

[58] Field of Search ..... 210/108, 169, 411, 416.2, 210/448, 794, 798, 232, 776, 797, 425–427, 791

[56] References Cited

U.S. PATENT DOCUMENTS

| | | | |
|---|---|---|---|
| 2,980,256 | 4/1961 | Nash | 210/411 |
| 3,117,584 | 1/1964 | Elenbaas | 134/168 |
| 3,252,575 | 5/1966 | Jacuzzi | 210/425 |
| 3,365,064 | 1/1968 | Horan | 210/425 |
| 3,535,161 | 10/1970 | Gutrich | 134/167 |
| 3,957,644 | 5/1976 | Edmonson | 210/448 |
| 4,030,513 | 6/1977 | McKenzie | 134/167 |
| 4,154,679 | 5/1979 | Farage | 210/169 |
| 4,194,975 | 3/1980 | Baker | 210/411 |
| 4,348,281 | 9/1982 | Perry et al. | 210/169 |
| 4,454,035 | 6/1984 | Stefan | 210/169 |
| 4,505,643 | 3/1985 | Mills et al. | 210/169 |
| 4,519,914 | 5/1985 | Etani | 210/169 |
| 4,676,914 | 6/1987 | Mills et al. | 210/169 |
| 4,704,202 | 11/1987 | Poyner | 210/169 |
| 4,714,551 | 12/1987 | Bachhofer et al. | 210/425 |
| 4,737,279 | 4/1988 | Lewis | 210/416.2 |
| 4,746,424 | 5/1988 | Drew | 210/169 |
| 4,849,024 | 7/1989 | Supra | 210/169 |

*Primary Examiner*—Frank Spear
*Assistant Examiner*—Joseph Drodge
*Attorney, Agent, or Firm*—Adrian D. Battison; Stanley G. Ade; Murray E. Thrift

[57] ABSTRACT

A conventional filtering system of a swimming pool is modified by the provision of an adaptor which is shaped to be inserted into the discharge opening of the pool skimmer so as to prevent extraction of water from the pool into the filter system. The plug member is shaped with a lower cylindrical plug portion two inches in diameter so as to insert into the discharge opening. A channel runs along the length of the plug member and opens at its upper end into a female screw threaded coupling for receiving the conventional male screw threaded end of a garden hose through which fresh water is supplied for the backwashing of the filter.

10 Claims, 2 Drawing Sheets

BACKWASHER ADAPTOR FOR SWIMMING POOL FILTER SYSTEM

BACKGROUND OF THE INVENTION

This invention relates to a backwash adaptor for a swimming pool filter system which enables backwashing of the filter to be carried out without loss of water from the swimming pool itself so that the backwashing is carried out with fresh water from an alternative source.

A swimming pool filter system generally includes a skimmer which allows water to run from the upper surface of the pool into the skimmer body from which it is extracted by an extraction pipe and carried to a filter for filtration of any solid material before returning of the filtered water to the pool. A pump is positioned in the line driving the water from the skimmer body through the filter and back to the pool.

For effective and proper maintenance of the pool water it is necessary to backwash the filter on a regular basis at least several times per week and preferably daily. Backwashing involves the reversal of the direction of flow of the water through the filter so that the trapped solids are carried away from the filter by the reverse flow water and then discarded with the water. For this purpose the filter generally includes a valve arrangement which can be manually operated to reverse the direction of flow so that the water withdrawn from the pool instead of being filtered acts as the backwashing medium. It is of course not possible to return the reverse flow fluid to the pool since this would merely return the extracted solids to the pool. It is therefore necessary to discard the water from the pool either into an area of the yard surrounding the pool or into the sewer system.

The pool water thus extracted and discarded is of course heated and contains significant quantities of chemicals necessary for keeping the pool waterfresh. Very approximately one and a half percent of the pool water is necessary to carry out an effective backwashing and if repeated at the preferred rate, this will discard a significant amount of the pool water. This pool water must of course be replaced, with of course the necessity to reheat the fresh water and to add the necessary further chemicals to the fresh water.

SUMMARY OF THE INVENTION

It is one object of the invention, therefore, to provide an improved filter system for the swimming pool which includes an adaptor and arrangement enabling the backwashing to be carried out without using water from the pool which must be replaced with fresh water from an alternative source.

According to the first aspect of the invention, therefore, there is provided a device for use in backwashing a swimming pool filter system of the type including a pool skimmer having a discharge opening for water extracted from the pool into the skimmer, an extraction pipe connecting from the discharge opening to a filter, a return pipe connecting from the filter for returning filtered water to the pool, a pump for driving water from the skimmer through the filter to the pool, means on the filter for reversing flow through the filter of water from the extraction pipe, and means for dispensing said reverse flow water from the filter, the device comprising a plug member shaped and arranged to be inserted into the discharge opening so as to substantially prevent the flow of water from the skimmer into the extraction pipe, said plug member having at a position accessible from the skimmer a coupling thereon for attachment to a garden hose, and a channel extending through the plug member from the coupling to a position on the plug member discharging into said extraction pipe for providing clean water from the hose for said backwashing.

According to a second aspect of the invention, therefore, there is provided a method of filtering a swimming pool comprising withdrawing water from the pool into a skimmer, pumping the water from the skimmer through a filter for return to the pool, halting flow of water from the skimmer to the filter, injecting fresh water from a separate source into the filter, reversing the flow of the fresh water through the filter so as to backwash the filter, and dispensing the water from the filter.

According to a third aspect of the invention, therefore, there is provided a swimming pool filter system comprising a pool skimmer having a discharge opening for water extracted from the pool into the skimmer, an extraction pipe connecting from the discharge opening to a filter, a return pipe connecting from the filter for returning filtered water to the pool, a pump for driving water from the skimmer through the filter to the pool, means on the filter for reversing flow through the filter of water from the extraction pipe, means for dispensing said reverse flow water from the filter, and an adaptor device comprising a plug member shaped and arranged to be inserted into the discharge opening so as to substantially prevent the flow of water from the skimmer into the extraction pipe, said plug member having at a position accessible from the skimmer a coupling thereon for attachment to a garden hose, and a channel extending through the plug member from the coupling to a position on the plug member discharging into said extraction pipe for providing clean water from the hose for said backwashing.

The device according to the invention not only makes the daily operation and maintenance of the pool very much easier it is also results in a significant saving of cost in chemicals, heating and water. As the water now discarded from the backwashing action contains little or no chemicals, it can be used for irrigation purposes without the danger of the chemicals damaging the plants. While basically the same amount of water therefore is used for the system, using the present invention it is possible to utilize the discarded water thus reducing the need for further irrigation water at other times.

With the foregoing in view, and other advantages as will become apparent to those skilled in the art to which this invention relates as this specification proceeds, the invention is herein described by reference to the accompanyng drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 4:
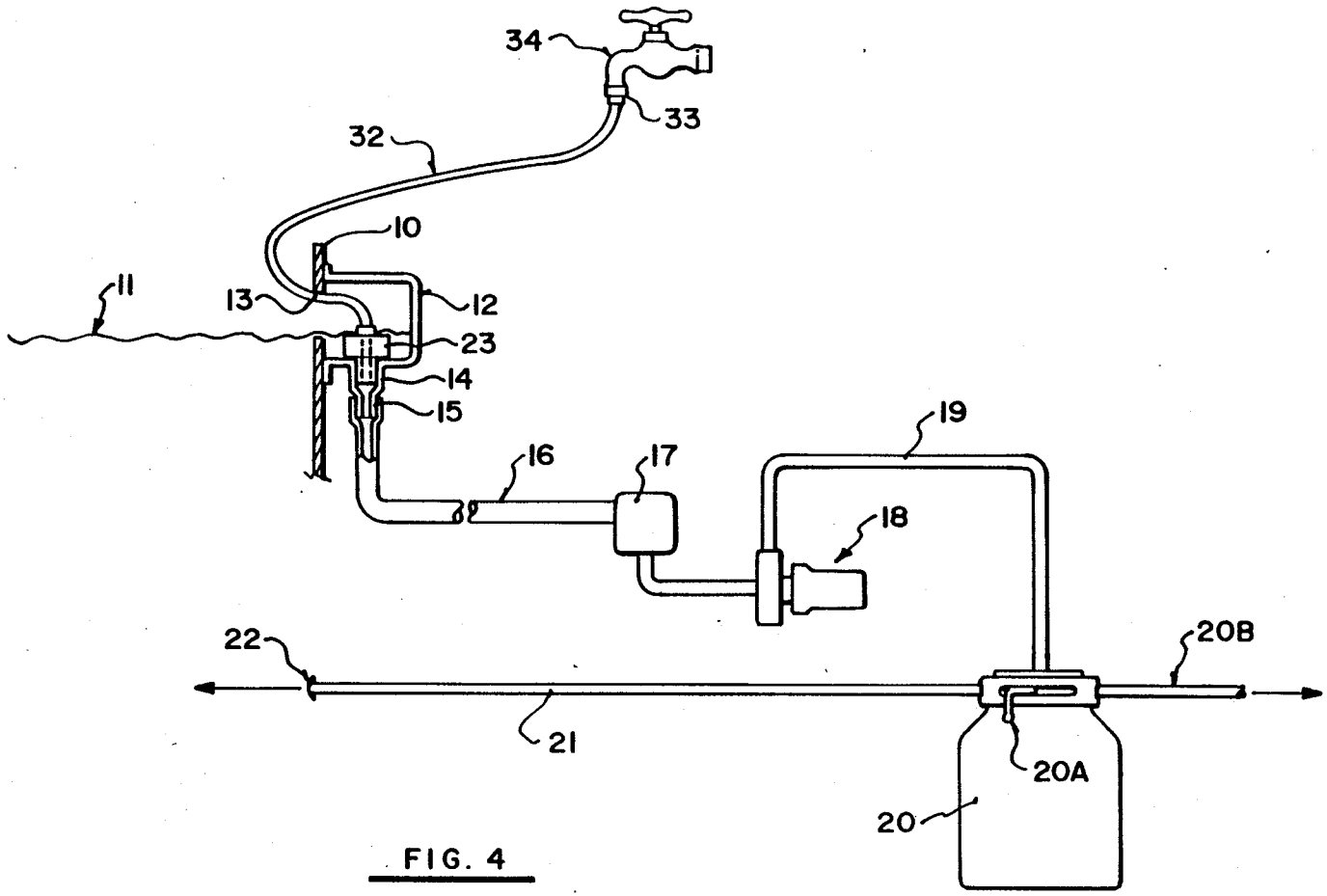
FIG. 4 is a schematic illustration of a pool filter system incorporating the adaptor of FIG. 1.

Referring firstly to FIG. 4, there is shown the wall of a swimming pool indicated at 10 which contains water 11. A skimmer 12 is mounted on the side wall at an opening 13 in the side wall which allows the water to run freely through the opening so as to skim material from the surface of the water. The skimmer normally contains a basket which catches larger materials such as leaves, frogs and the like but in the position shown, the basket is removed. The skimmer body includes a discharge opening 14 at the lower end which comprises a molded cylindrical sleeve projecting downwardly from the underside of the body and defining a spigot 15 for receiving one end of an extraction pipe 16. The extraction pipe 16 connects to an inlet filter 17 of a pump 18 which acts to withdraw the water along the extraction pipe and drive it through a connecting pipe 19 into a filter 20 which is generally a sand filter of conventional construction. In normal operation of the filter system, the force from the pump drives the water through the filter and then through a return pipe 21 to an eyeball or inlet jet 22 in the side wall of the pool so that the water is injected back into the pool for recirculation.

Figure 1:
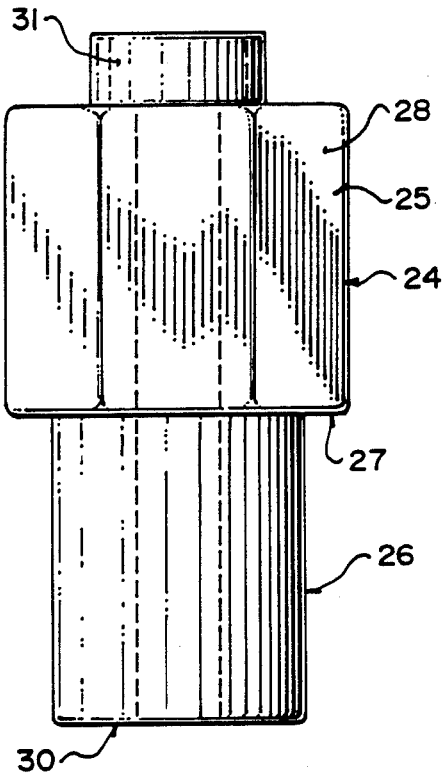
FIG. 1 is a side elevational view of an adaptor according to the invention.
Figure 2:
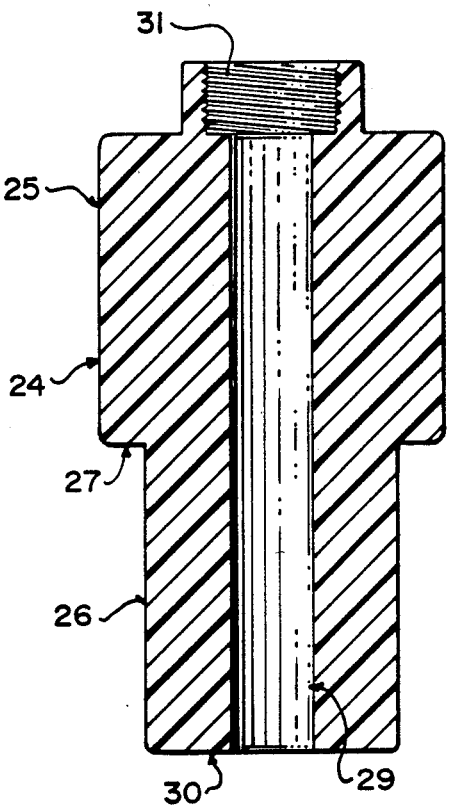
FIG. 2 is a longitudinal cross sectional view of the adaptor of FIG. 1.
Figure 3:
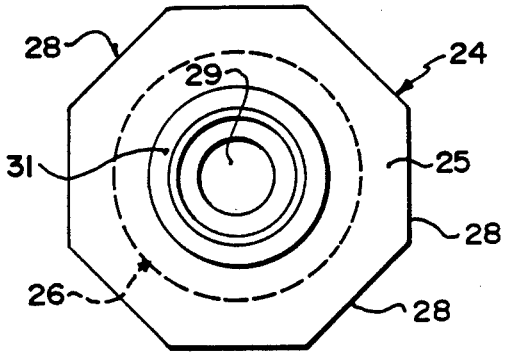
FIG. 3 is a top plan view of the adaptor of FIG. 1.

The adaptor according to the invention is indicated at 23 and is inserted into the outlet opening 14 of the skimmer. Turning therefore to FIGS. 1, 2 and 3, the adaptor is shown in more detail and comprises an integrally molded body 24 having an upper plug portion 25 and a lower plug portion 26 defining therebetween a shoulder 27. The lower plug portion 26 is of a circular cylindrical shape so as to define a constant circular cross section of a diameter of the order of slightly less than 2 inches so that it can be inserted into the conventional 2 inch inside diameter discharge opening 14 of the skimmer body.

The upper plug portion 25 has a slightly larger diameter so as to form the shoulder 27 and is polygonal in shape so as to define sides 28 which can be grasped by the hand of the user for rotating the plug body when necessary. As shown in FIG. 3, the polygonal shape is a regular octagon.

Centrally of the molded body is formed a channel 29 which extends through the body from an upper end to a lower flat face 30 of the body at the underside of the lower plug portion 26. The upper end of the channel 29 breaks out into a female screw threaded coupling 31 on the upper surface of the upper portion. The female screw threaded coupling is of a type for cooperation with the conventional male screw threaded coupling of a garden hose 32 shown in FIG. 4.

In operation, when it is desired to backwash the filter 20, the adaptor or plug member 23 is attached to the remote end of the garden hose 32 with the female end of the garden hose indicated at 33 attached to a suitable tap 34 supplying fresh water from the main supply. With the hose so attached, the plug member is passed through the opening 13 and inserted into place into the discharge opening 14 of the skimmer where it is held by the vacuum action generated by the inlet side of the pump 18. At this time the tap 34 can be opened to allow fresh water to run into the hose 32 and thus through the channel 29 and into the extraction pipe 16.

The filter includes a manually operable lever 20A which can be moved to a backwash position in which the fresh water from the pipe 32 is injected through the connecting line 19 into the filter and then passes through the filter in a reverse direction and is discharged from the filter through a discharge line 20B for use in irrigation or other purposes.

When the backwashing is complete, the lever 20A is returned to its initial position, the tap 34 is closed and the plug member 23 is removed from the discharge opening 14 to allow operation of the filter system to continue.

The shape of the plug member is thus closely designed and configured in order to act to plug the discharge opening 14 and for this purpose the length of the lower plug portion 26 is generally of the order of two inches with the diameter slightly less than two inches so that it is a sliding fit within the inside of the discharge opening. The polygonal shape of the upper plug portion enables it to be grasped and rotated relative to the male screw thread portion of the garden hose so that the coupling can be tightened.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A method of filtering a swimming pool comprising the steps of withdrawing water from the pool into a skimmer, pumping the water through a discharge opening of the skimmer through a filter in a filtering direction to form filtered water leaving filtered materials in the filter, returning the filtered water to the pool, inserting a plug member into the discharge opening of the skimmer to temporarily halt flow of water from the skimmer to the filter, while the flow from the skimmer is halted injecting fresh water from a source of fresh water separate from the pool through the plug member so as to travel to the filter, pumping the fresh water through the filter in a backwash direction opposite to said filtering direction so that the fresh water strips said filtered materials from the filter, discharging separately from the pool the fresh water and filtered materials, halting the fresh water from said separate source and removing the plug member to restore the flow of water from the skimmer through said filter in said filter direction.

2. A swimming pool filter system comprising a pool skimmer having a discharge opening for water extracted from the pool into the skimmer, an extraction pipe connecting from the discharge opening to a filter, a return pipe connecting from the filter for returning filtered water to the pool, a pump for driving water from the skimmer through the filter to the pool, filter backwash means for reversing flow through the filter of water from the extraction pipe for backwashing said filter, backwash water discharging means for discharging said reverse flow water from the filter separately from the pool, a garden hose, a supply of fresh water separate from the pool water connected to the garden hose and an adaptor device comprising a plug member having a cylindrical plug portion having a cross-section substantially equal to that of the discharge opening so as to be inserted into the discharge opening and to substantially prevent the flow of water from the skimmer into the extraction pipe, said plug member having mounted thereon at a position accessible from the skimmer a coupling attached to said garden hose, and a channel extending through the plug member from the coupling to a feed opening on the plug member discharging into said extraction pipe providing said fresh water from the hose for said backwashing.

3. The invention according to claim 2 wherein the coupling comprises a female screw threaded coupling dimensioned and configured to receive a conventional male screw threaded coupling of said garden hose.

4. The invention according to claim 2 wherein the plug member comprises a generally cylindrical body defining a first cylindrical plug portion having an outer cylindrical surface surrounding a longitudinal axis of the body for inserting into a pipe portion at said discharge opening, said channel having said feed opening in an end face of the first plug portion which lies in a plane radial to the longitudinal axis, and a shoulder at an end of the first plug portion remote from the end face for engaging an end of the pipe portion to hold said plug member in said discharge opening.

5. The invention according to claim 4 wherein the first plug portion includes an outer diameter which is substantially constant and which is slightly less than 2 inches.

6. The invention according to claim 4 wherein the coupling is arranged at an end face of the plug member which lies in a plane radial to the longitudinal axis and is opposite to said end face of the first plug portion.

7. The invention according to claim 6 wherein the channel extends from the coupling substantially axially along the plug member.

8. The invention according to claim 6 wherein the channel has a diameter of the order of ½ inch.

9. The invention according to claim 4 wherein the plug member includes a second plug portion coaxial with the first plug portion with one end of the second plug portion defining said shoulder.

10. The invention according to claim 9 wherein the second plug portion includes at least a part thereof which, in cross section traverse to the axis, is polygonal.

* * * * *